US005804279A

United States Patent [19]

Pluth

[11] Patent Number: 5,804,279

[45] Date of Patent: Sep. 8, 1998

[54] DETAILING TOWEL

[76] Inventor: Dean Pluth, 9243 Filbert Dr., St. Louis, Mo. 63137

[21] Appl. No.: 900,690

[22] Filed: Jul. 25, 1997

[51] Int. Cl.[6] ..... B32B 3/04

[52] U.S. Cl. ..... 428/124; 428/192; 15/244.3

[58] Field of Search ..... 428/124, 122, 428/192; 15/244.3, 209.1; 5/417, 419, 420; 383/4; 190/2

*Primary Examiner*—Alexander Thomas
*Attorney, Agent, or Firm*—Polster, Lieder, Woodruff & Lucchesi

[57] ABSTRACT

A cleaning towel of the present invention has a top edge, a bottom edge, and side edges, and at least one pocket extending between the side edges at the bottom edge of the towel. The pocket has an outer face and an inner face which are connected to each other along a top edge of the pocket. The pocket inner face is adjacent, but separate from the towel, and the pocket thus defines a first pocket area between the pocket outer face and the pocket inner face and a second pocket area between the pocket inner face and the towel. The pocket second area is opened at the top and is externally accessible. The pocket inner face is shorter than the pocket outer face and the pocket first area is accessible through the pocket second area. A sponge is placed in the first pocket area of the at least one pocket. The first pocket area is sized to snugly receive the sponge. The sponge is one can which withstand high heat, such as the heat from a clothes dryer. Preferably, the sponge is a cellulose sponge.

10 Claims, 1 Drawing Sheet

DETAILING TOWEL

BACKGROUND OF THE INVENTION

This invention relates to detailing towels for use in washing cars, boats, etc. and, in particular, to such a towel which incorporates pockets to hold a sponge while cleaning.

Owners of boats, cars, etc. often clean their cars and boats using sponges, towels, etc. It is difficult, especially when the person cleaning a boat is in the water, to hold on to a sponge or towel and maintain a position relative to the boat. If a towel is used and the towel is dropped, the towel can sink or float away. If a sponge is used, the sponge can float away from the boat if it is inadvertently released.

BRIEF SUMMARY OF THE INVENTION

One object of the present invention is to provide a detailing towel which can be used for cleaning water and land craft.

Another object is to provide such a towel which includes a sponge.

These and other objects will become apparent to those skilled in the art in light of the following description and accompanying drawings.

Briefly, a detailing towel of the present invention has a top edge, a bottom edge, and side edges, and at least one pocket extending between the side edges at the bottom edge of the towel. The pocket has an outer face and an inner face which are connected to each other along a top edge of the pocket. The pocket inner face is adjacent, but separate from the towel. The pocket thus defines a first pocket area between the pocket outer face and the pocket inner face and a second pocket area between the pocket inner face and the towel. The pocket second area is opened at the top and is externally accessible. The pocket inner face is shorter than the pocket outer face and the pocket first area is accessible through the pocket second area. The towel preferably includes two or more pockets. The pockets are formed by folding the towel over upon itself twice, and then sewing the sides of the folded portion of the towel to a back surface of the towel.

A sponge is placed in the first pocket area of the at least one pocket. The first pocket area is sized to snugly receive the sponge. The sponge is one can which withstand high heat, such as the heat from a clothes dryer. Preferably, the sponge is a cellulose sponge.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
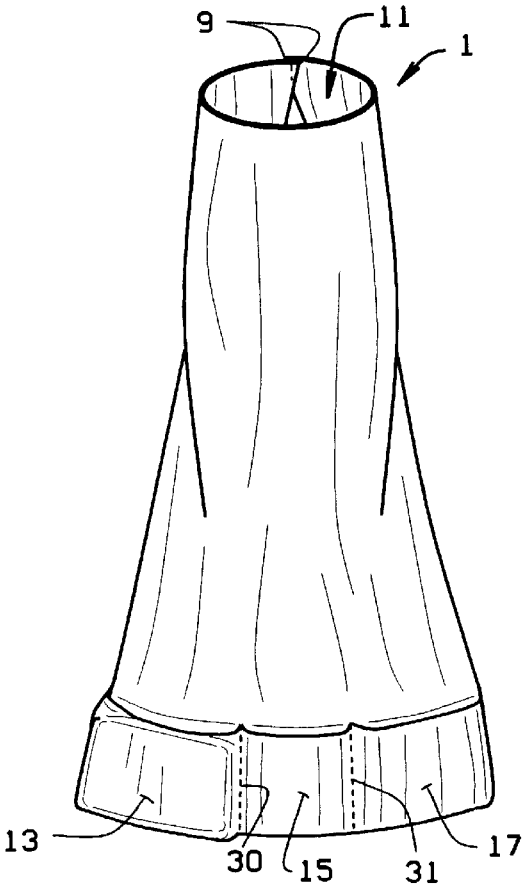
FIG. 1 is a perspective view of a detailing towel of the present invention with the top corners of the towel connected to each other.
Figure 2:
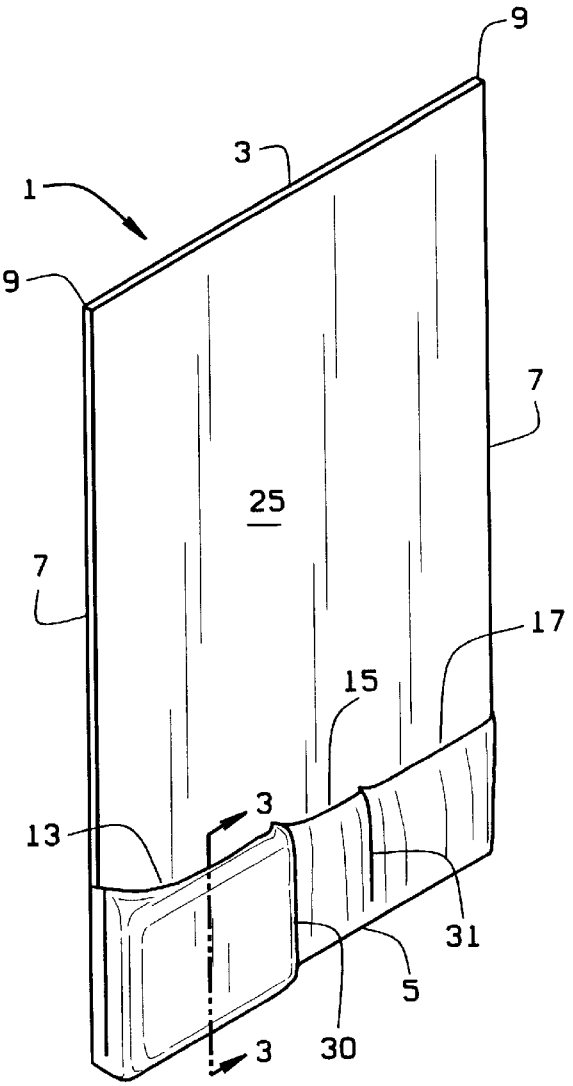
FIG. 2 is a perspective view of the towel when flat.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

A detailing towel 1 of the present invention is shown generally in the Figures. The towel 1 can be made of any suitable textile, but is preferably made of a cotton terry cloth. The towel 1 has a top edge 3, a bottom 5, sides 7, and top corners 9 where the sides 7 and the top edge 3 intersect. The top corners 9 are preferably connected to each other to create a loop or circle 11 at the top of the towel. The corners 9 can be tacked together with thread, snaps, a rivet, a button, or any other conventional means of connecting two corners together.

Three pockets 13, 15, and 17 are formed at the bottom of the towel. The pockets each include a front face 19, a top edge 21, and an inner face 23. The bottom edge 5 forms the bottom of the pockets. The inner face 23 is shorter than the front face 19 and is not connected to the face 25 of the towel. Each pocket thus forms two areas, a first area 27 between the inner and front faces 23 and 19 and a second area 28 between the inner face 23 and the face 25 of the towel. The pockets 13, 15, and 17 can be made from a single panel of cloth which is fixed to the towel or individual panels of cloth which are fixed to the towel. However, the pockets are preferably formed by folding the bottom of the towel over itself twice. The towel is folded a first time to along a line which becomes the top 21 of the pockets, and a second time along a line which becomes the bottom 5 of the towel and the pockets. As can be appreciated, the bottom edge 29 of the inner face 23 is the bottom of the towel prior to folding of the towel to make the pockets 13–17. The bottom edge 29 of the inner face 23 is not sown to either the face 25 of the towel or the pocket front face 19. Thus, the pocket area 27 is accessible through a gap between the bottom edge 29 of the pocket inner face 23 and the bottom edge 5 of the towel.

To form multiple pockets from the folded towel, vertical stitching as at 30 and 31 is provided. The stitching 30 and 31 passes through both faces of the pockets and through the towel face 25 so that the pockets are fully separated from each other. The sides of the side pockets 13 and 17 are closed by stitching the sides of the folded portion of the towel to the towel face 25 near the edges 7 of the towel. Although three pockets are shown in the drawings, more or fewer pockets could be provided, as may be desired.

Figure 3:
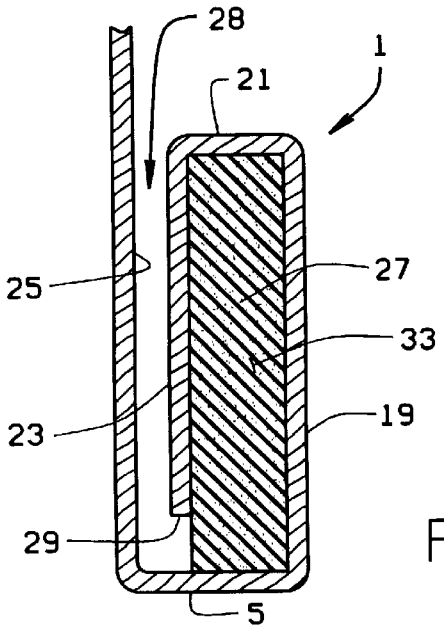
FIG. 3 is a cross-sectional view of the towel taken along line 3—3 of FIG. 2

As seen in FIG. 3, a sponge 33 is received in the pocket area 27 of pocket 13. The towel, of course, is highly flexible, as is the sponge, and the sponge 33 is inserted in the pocket area 27 by passing the sponge 33 through the gap between the bottom edge 39 of the inner pocket face 23 and the bottom edge 5 of the towel. When the sponge 33 is in the pocket area 27, it is well retained in the pocket and cannot easily fall out of the towel 1.

The sponge 33 is preferably a cellulose sponge, which can withstand the heat of a washing machine and dryer. The cellulose sponge is preferably a coarse-pored, wood fiber sponge. Thus, the towel, with the sponge still in it, can be washed in a washing machine and then dried in a dryer. Because the sponge need not be taken out of the towel 1 to wash and dry the towel, the lines of stitching around the pocket panels will be stretched infrequently, and the towel will therefore last longer. If the sponge had to be removed from the towel to wash and dry the towel, the stitching which forms the pockets could become loose more quickly. The sponge of course can be removed from the towel, for example, to replace the sponge or for the towel and sponge to be used independently of each other.

When the towel is used, for example, in cleaning a boat already in the water, the user can pass his arm through the hole or loop 11 formed at the top of the towel 1 when the corners 9 are connected to each other. This will enable the user who is in the water to hold on to the towel with out actually having to grip the towel with his hand. The user can insert his hand into the area 28 of one of the pockets 13–17 to wash the boat. The pocket areas 28 thus in effect form hand mitts. When the towel is not being used to wash a boat, the bottom edge 5 can be passed through the hole or loop 11 and the towel can be secured to a railing of the boat. In a garage, for example, the hole or loop 11 can be used to hang the towel 1 on a hook. The pocket areas 28 can be used to store cleaning supplies, such as soap, wax, polish etc., when the towel is not being used.

As can be appreciated, the towel 1 is one which is easy to hold onto and use in a water environment as well as in a land environment. The fact that the sponge 33 is contained in the towel prevents the sponge from being separated from the towel, facilitating easy use of the towel. Further, if the towel is inadvertently released, the sponge will aid in preventing the towel from sinking. Because the sponge is a cellulose sponge, it will not loose its buoyancy when immersed in water.

In view of the above, it will be seen that the several objects and advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, other types of sponges could be used. More than one of the pocket areas 28 can be filled with sponges. Alternatively, one of the pocket areas could be filled with bar soap or a soap dispenser, which upon pressure, would release soap to be used to clean the boat, car, etc. In this case, the towel could be used in the shower for someone to clean themselves. The person could pass his or her arm through the loop 11 and place his or her hand in one of the pockets to more easily hold onto the towel. The towel could be made of other types of soft material which can be used for cleaning surfaces. For example, the towel could be a chamois towel. If the pockets are made from panels which are fixed to the towel, the inner and outer areas of the pocket could be formed from two different panels. The panels could then be joined at their tops, for example, by hook-and-pile fasteners, snaps, zipper, etc., so that the outer pocket area 27 will be closed at its top. These examples are merely illustrative.

I claim:

1. A towel having a top edge, a bottom edge, and side edges, at least one pocket extending between the side edges at the bottom edge of the towel; the pocket having an outer face and an inner face, the pocket outer face and inner face being connected to each other along a pocket top edge, the inner face being between the outer face and a face of the towel and separate from the towel; the pocket defining a first pocket area between the pocket outer face and the pocket inner face and a second pocket area between the pocket inner face and the face of the towel; the pocket inner face being shorter than the pocket outer face; the pocket first area being accessible through the pocket second area; the pocket second area being externally accessible.

2. The towel of claim 1 wherein the at least one pocket includes two or more pockets, the pockets being separated by lines of stitching which extend from the bottom edge of the towel to the pocket top edge.

3. The towel of claim 1 wherein the at least one pocket is formed by folding the towel over upon itself twice.

4. The towel of claim 1 including a sponge received in the at least one pocket, the sponge being received in the first pocket area of the at least one pocket.

5. The towel of claim 4 wherein the sponge can withstand high heat.

6. The towel of claim 5 wherein the sponge is a cellulose sponge.

7. A towel having a top edge, a bottom edge, and side edges, at least one pocket extending between the side edges at the bottom edge of the towel; the pocket having an outer face and an inner face, the inner face being adjacent and separate from the towel; the pocket defining a first pocket area between the pocket outer face and the pocket inner face and a second pocket area between the pocket inner face and the towel; the pocket first area being closed along a top edge of the pocket, and the pocket second area being opened along the pocket top edge.

8. The towel of claim 7 wherein the pocket inner face is fixed to the pocket outer face along the top edge of the pocket, the pocket inner face being shorter than the pocket outer face; the pocket first area being accessible through the pocket second area.

9. The towel of claim 7 including a sponge, the pocket first area being sized to receive the sponge.

10. The towel of claim 9 wherein the pocket second area is sized to receive a hand of a user.

* * * * *